United States Patent [19]

Grate

[11] Patent Number: 4,461,107

[45] Date of Patent: Jul. 24, 1984

[54] MENU BOARD

[76] Inventor: Anton J. Grate, 3211 Burr Oaks Rd., Joliet, Ill. 60435

[21] Appl. No.: 412,029

[22] Filed: Aug. 26, 1982

Related U.S. Application Data

[63] Continuation-in-part of Ser. No. 297,231, Aug. 28, 1981.

[51] Int. Cl.[3] ..... G09F 13/04

[52] U.S. Cl. ..... 40/576; 40/611; 40/615; 434/430

[58] Field of Search ..... 40/18, 576, 611, 615, 40/490, 491, 16, 575, 577, 576; 434/430

[56] References Cited

U.S. PATENT DOCUMENTS

| | | | |
|---|---|---|---|
| 931,382 | 8/1909 | Cairncross | 40/576 |
| 1,974,881 | 9/1934 | Spillane | 40/16 |
| 2,186,817 | 1/1940 | Bowers | 40/16 |
| 2,430,646 | 11/1947 | Ownbey | 40/576 |
| 2,447,978 | 8/1948 | Hall | 40/611 |
| 3,251,151 | 5/1966 | Sherrill | 40/16 |
| 3,824,723 | 7/1974 | Gargas | 40/367 |
| 4,035,940 | 7/1977 | Mickey et al. | 40/611 |
| 4,044,710 | 8/1977 | Hansen | 40/611 |
| 4,292,752 | 10/1981 | Clark | 40/615 |

*Primary Examiner*—Robert Peshock
*Assistant Examiner*—Kris R. Schulze
*Attorney, Agent, or Firm*—John L. Parker

[57] ABSTRACT

A menu board is provided which utilizes members carrying interchangeable numbers, letters or other characters, and possesses special features which render the menu board highly legible. The menu board is provided with window-like openings and means for replaceably mounting the interchangeable character members behind the board openings. The character members include appendages selectively engageable with end stops provided on the board, or with slots provided on the board for positioning and locking the members in place. In one embodiment, the characters are each of a selected length and are overlaid one upon the other within the board openings, but so that the characters themselves are not overlain as viewed from the front of the menu board. Alignment means is provided for controlling the registration of the characters with respect to one another within the windows, and locking means is provided for securing each group of character members in place. In another embodiment, a plurality of slots are spaced along the length of a given board window, the slots being engageable by the appendages carried by the character members to secure the menu information at any location desired within the window. In yet another embodiment, the character members are placed in end-to-end relationship and are separately mounted in the board window via the slots and appendages.

6 Claims, 11 Drawing Figures

FIG. 1
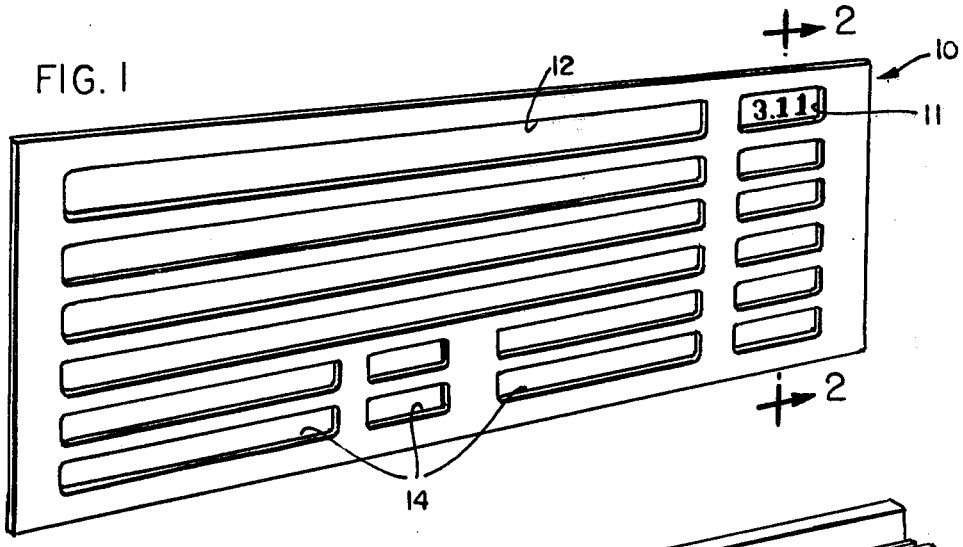
FIG. 2
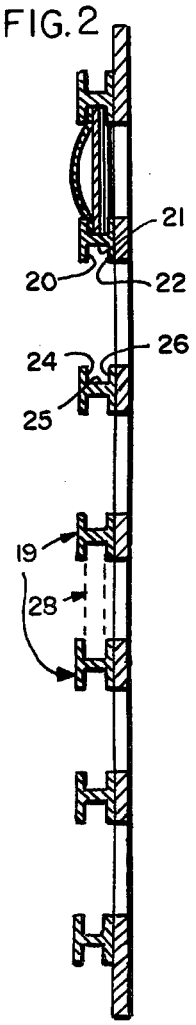
FIG. 3
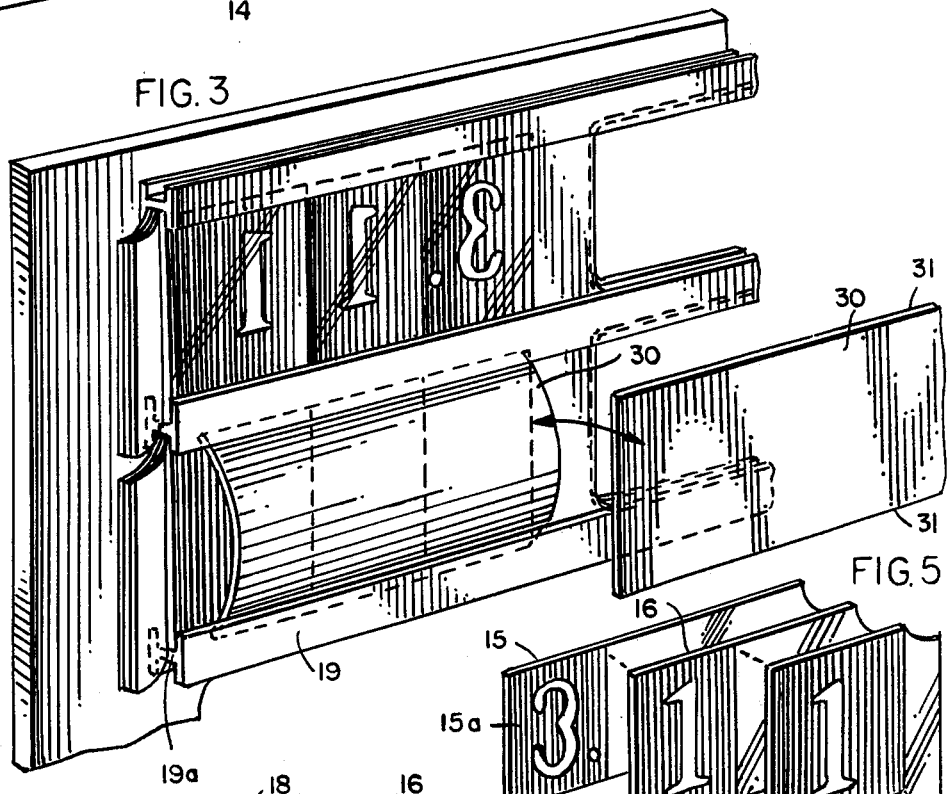
FIG. 5
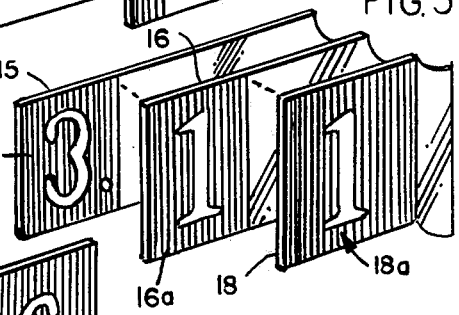
FIG. 4
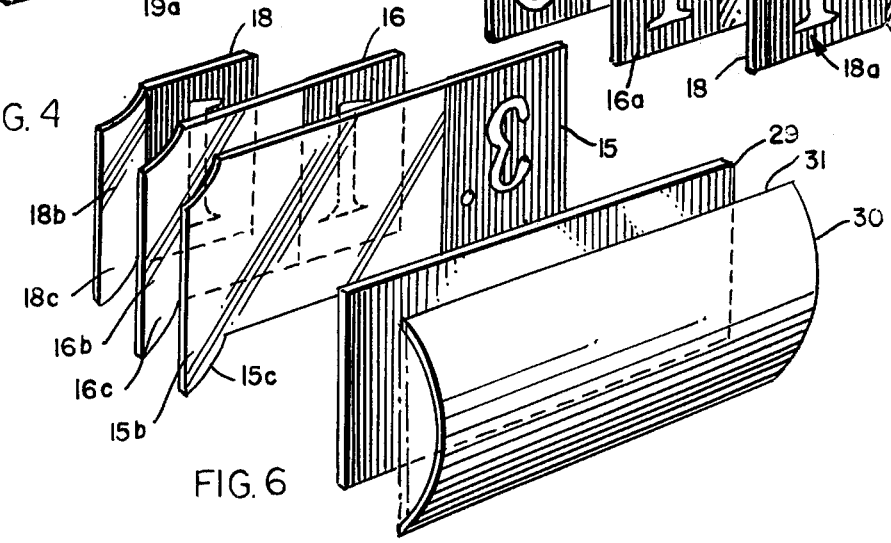
FIG. 6

W/VARIATIONS

HAMBURGERS
HAMBURGERS with FRIES
.89
1.28
QUALITY

MENU BOARD

DESCRIPTION OF THE INVENTION

This application is a continuation-in-part of my application Ser. No. 297,231, filed Aug. 28, 1981.

This invention relates generally to menu boards, and more particularly to such boards utilizing interchangeable numbers, letters or other characters thus facilitating simple and quick changes in the information carried by the boards.

Most fast-food restaurants, drive-ins and stores present a menu board to the customer entering the establishment. It is important that such menu boards present information as to the products available, and their prices, in a simple and easily read manner. In many such businesses, such a menu board is displayed at a front serving counter of the establishment. Typically, a customer in such a restaurant or store, when present at the serving counter, is located from 10 to 15 feet away from the menu board. It is essential that each customer be able to read the menu board quickly so as to minimize the time spent standing in line waiting for service. Thus, it becomes important to have maximum legibility and clarity in the information that is presented on the menu board. The less confusing the menu board is to read, the sooner the customer is able to make a choice and place his order. Especially during peak periods of customer traffic, such as lunchtime, it is essential to minimize the time necessary for each customer to make a decision as to his order. A highly legible menu board speeds up service and increases customer turnover, with the result that the volume of sales per unit time is increased.

One of the principal causes of impaired legibility of such menu boards is light reflection or glare. This is encountered often when the letters or numbers displayed on the board are carried by layers or strips of clear plastic or the like, with the strips arranged to partially overlay each other so that one or more numbers must be viewed through a layer of clear plastic.

It is an object of the present invention to provide an improved menu board which is inexpensive, simple, and provides exceptional legibility. An allied object is to provide such an improved menu board in which prices or other information carried by the board may be quickly and easily read without attendant glare and reflection from ambient light. Yet another object is to provide such an improved menu board in which prices or product names may be quickly and easily changed or revised with a minimum of effort.

In the drawings,

FIG. 1 is a perspective view of the front of an illustrative menu board which incorporates the present invention.

FIG. 2 is a vertical, sectional view taken along the line 2—2 in FIG. 1.

FIG. 3 is an enlarged, fragmentary perspective view of a corner of the illustrative menu board, as viewed from the back of the board, showing an illustrative locking clip for the board characters, both locked into place and in relaxed condition prior to locking (see arrow).

FIGS. 4 and 5 are exploded perspective views showing back and front views, respectively, of illustrative character members utilized in carrying out the invention.

FIG. 6 is an exploded perspective view, similar to FIG. 4, of an illustrative background member for the characters and locking clip utilized in carrying out the invention.

Figures 7, 8, 9, 10, 11:
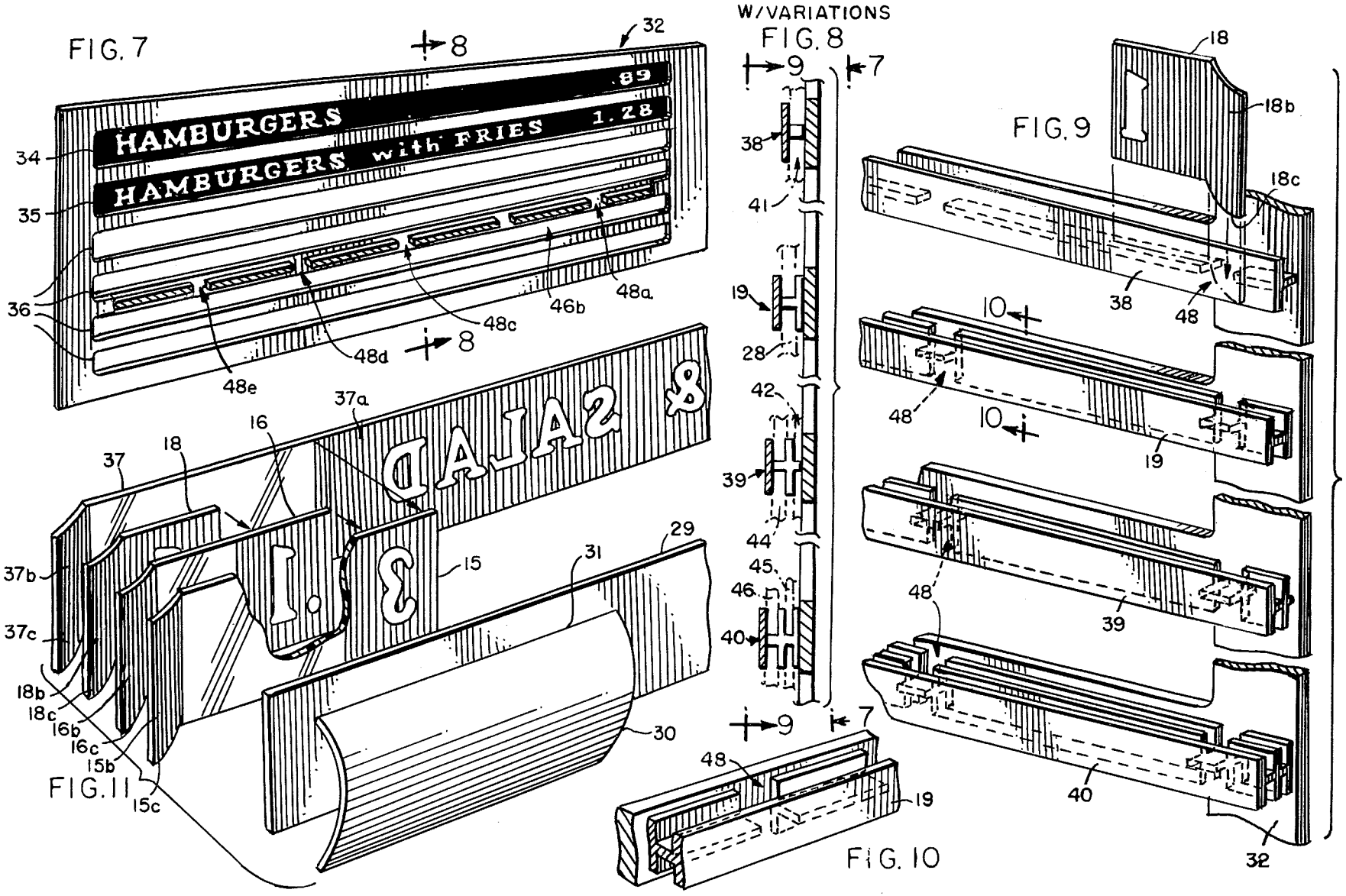
FIG. 7 is a perspective view of the front of an alternative form of illustrative menu board incorporating features of the present invention. This view is shown partly cut-a-way, with a vertical section being shown taken along the line 7—7 in FIG. 8.
FIG. 8 is a vertical sectional view taken along the line 8—8 in FIG. 7, illustrating several alternative forms of bars for use in conjunction with the menu board.
FIG. 9 is an enlarged fragmentary perspective view, partly exploded, of a portion of the back of the illustrative menu board shown in FIG. 7, showing particularly the relationship between the character members and the bars on the back of the board. This figure is generally aligned with, and corresponds to, the vertical sectional view of FIG. 8.
FIG. 10 is an enlarged fragmentary perspective view of a portion of the back of the illustrative menu board of FIG. 7, showing in detail the construction of an alternative form of the illustrative bars on the back of the board. This view is taken generally along the line 10—10 in FIG. 9.
FIG. 11 is an exploded perspective view of illustrative character members, and illustrative background and locking clip members, which may be utilized in carrying out the invention.

While the invention will be described in connection with certain preferred embodiments, it will be understood that I do not intend to limit the invention to those embodiments. On the contrary, I intend to cover all alternatives, modifications and equivalents as may be included within the spirit and scope of the invention.

As shown in FIG. 1, an illustrative menu board 10 is provided, which may be formed of plastic, wood, metal, or the like. The illustrative menu board 10 is flat and generally rectangular in shape, and is provided with one or more openings or windows 11, 12, 14 which are adapted to receive various combinations of letters or numbers making up the menu information to be displayed. For example, in the illustration in FIG. 1, the openings 12 and 14 on the left side of the menu board may include the names of the products to be sold, for example sandwiches, while the short windows 11 on the right hand side set forth the associated prices, for example, $3.11 shown in the upper window on the right side of the board.

The illustrative menu board 10 may be formed by routing the window-like openings 11, 12, 14 from a generally flat, planar plastic board. Of course, other constructions will be readily evident to those skilled in the art, for example, a cast plastic menu board may be machined to provide the necessary openings.

In carrying out the invention, I provide a plurality of character strips 15, 16, 18, which are specially sized, shaped and arranged to cooperate with one another in presenting menu information in a most legible fashion and without glare or reflection. As shown in the drawings, three separate character strips or members 15, 16, 18 are adapted to cooperatively display a given item of price information. Thus, in the illustration, the three character strips display a price of $3.11. In this instance, each digit appears on a separate character member. As shown, the character member representing dollars (including the decimal point) is depicted as member 15, the character depicting units of ten cents is member 16, and the cents character is depicted as member 18.

In order to facilitate removably affixing the character members 15, 16, 18 to the menu board 10, the back surface of the board is provided with a plurality of spaced bars 19 of H-shaped cross section arranged along the lateral edges of each of the windows 11, 12, 14 of the board. The bars 19 may be cemented or otherwise secured to the board. Through use of the H-shaped bar cross section, the internal surfaces 20, 21, 22 and 24, 25, 26 of each pair of these bars 19 associated with a given board window define an elongated sleeve or pocket 28 (shown dotted in FIG. 2) for receiving the digit or character carrying members 15, 16, 18. Once the character members 15, 16, 18 have been placed in their proper position behind a given window 11 of the board (described below), a background member 29 of contrasting color and appearance to that of the character strips is inserted behind the character members as explained below. Finally, a locking clip 30 is inserted in the back of the sleeve 28 to hold the characters firmly in place. For example, such a clip 30 may comprise a piece of thin plastic sheet which may be readily squeezed with thumb and forefinger into a concave shape and then inserted behind the characters 15, 16, 18 so that the longitudinal marginal edges 31 of the clip are wedged between the corresponding marginal edges of the characters and the sleeve 28 defined by the H-bars 19. Thus, as shown in FIG. 2, when the clip is in locking position, the clip edges 31 fit between the longitudinal marginal edges of the characters and the internal surfaces 20, 24 of the H-bars 19.

In keeping with the invention, the character members 15, 16, 18 constitute separate, adjacent, independently slideable strips of clear, transparent plastic or like material on which the respective digits or other characters are outlined and thereby defined by a surrounding opaque or dark surface; moreover, the plastic strips are respectively sized and arranged so that no digit is overlain, as viewed from the front of the menu board, by any portion of an adjacent plastic strip. Thus, as seen in FIGS. 4–6, each clear plastic character member 15, 16, 18 is provided with an opaque, dark and preferably matte finish character display area **15*a*, 16*a*, 18*a* which is generally rectangular and surrounds the digit itself. Each numeral appears in clear, transparent plastic, defined by a surrounding dark opaque material. The background member 29, which may be a strip of opaque plastic sheeting, provides desired contrast, and makes for ready legibility of the numbers. For example, the background member 29 may be yellow or white, to set off digits outlined by black display areas 15*a*, 16*a*, 18*a***.

In further keeping with the invention, the character strips 15, 16, 18 are arranged adjacently within the board sleeves 28 in such manner that each character is directly viewed from the front of the menu board without any intervening layer of plastic or other transparent material which might cause glare or reflection. That is, in my invention, I size and arrange the strips 15, 16, 18 so that there is no clear plastic layer overlapping, as seen from the front of the menu board, any of the digits or characters. I thus avoid the diffused appearance of the numbers on prior art menu boards in which clear plastic strips which overlie the numbers create glare and light reflection.

In bringing about the advantages of my invention, the lengths of the respective character members 15, 16, 18 are chosen so that when in place in the board sleeve 28, the opaque display area of each member just abuts that of the adjacent character member. As shown in the drawings, the display area **16*a* just reaches and abuts the display area 15*a*, and the display area 18*a* just abuts the area 16*a*. This is brought about by selectively sizing the lengths of the respective strips 15, 16, 18, and yet providing each of the different length strips with a common point of beginning 19*a*. The beginning point 19*a* is defined as the point of engagement between ear portions 15*c*, 16*c*, 18*c* of alignment tabs 15*b*, 16*b*, 18*b* which are integral with each character strip, and the end portion of the respective H-bar 19** (see FIG. 3).

In this way, the digit area **18*a* overlays two thicknesses of clear plastic (on strips 16 and 15), but is not itself overlain. Similarly, the digit area 16*a* overlays one thickness of clear plastic (on strip 15), but also is not itself overlain. Digit area 15*a* neither overlies a plastic strip nor is overlain. As a result, all three digit areas 15*a*, 16*a* and 18*a*** are viewed directly by a person reading the menu board, thus avoiding the glare and reflection incident to prior menu boards in which some of the digits are arranged behind, and thus must be viewed through, one or more layers of clear plastic. In my invention, then, there is no impairment of the visibility of the price or other information contained on the menu board.

In assembling the illustrative menu board 10, the store proprietor or worker successively inserts the three character members 15, 16, 18 by manually sliding them into the sleeve 28 behind the corresponding window 11 of the board. This is done by first inserting the longest member, the dollars digit 15 in the sleeve 28, then by sliding the next longest member, ten cent digit 16 over digit 15 and into place, and finally by sliding the cents digit 18 over digit 16. As described, the alignment tabs **15*b*, 16*b*, 18*b* and appendages 15*c*, 16*c*, 18*c* assure that the three character strips are all properly aligned with respect to one another, since the ears are sized and arranged to form stops for the lateral movement of each strip once it is in place within the board sleeve 28. In other words, each character member will slide inwardly into position within the sleeve 28 until such point as the ear 15*c*, 16*c* or 18*c* engages the end portion 19*a* of the H-bar. In this way, the ears 15*c*, 16*c*, 18*c* serve to self center and align the numbers. The lengths of each of the character members is chosen in such manner as to assure that when the three members 15, 16, 18**, are in place within the window, they will be perfectly aligned with respect to one another. Thus, there is no overlap between numbers, nor is there any clear plastic covering over any number.

As indicated, I prefer that the portion of the character member 16 which underlies the digit display area **18*a*, and the portion of the character member 15 which underlies the digit areas 16*a* and 18*a*, be transparent. In this way, the digits defined by all three areas 15*a*, 16*a*, 18*a* appear to have the same brightness or intensity as viewed from the front of the menu board. In other words, the degree of brightness or intensity imparted to each of the digits by the background member 29 will be generally the same as between the three digits in view of the fact that the portions of the strips 15, 16** which underlie the other digits are formed of clear, transparent plastic.

Turning now to FIG. 7 of the drawings, an alternative form of menu board 32 is shown. Like the embodiment shown in FIG. 1, the board 32 is flat and generally rectangular in shape and is provided with a plurality of windows 34, 35, 36 adapted to receive the menu information. As in the case of the menu board of FIGS. 1–6, the board may be mounted as the front panel of a box or other structure (not shown) containing a light source for back-lighting the menu board (i.e., illuminating the board from the interior of the box). Alternatively, the menu board may be illuminated from the exterior, as by an exterior display light source directed onto the front face of the board. In some instances, of course, the menu board may be non-illuminated.

The menu boards of FIGS. 1–6 and of FIGS. 7–11 may, as indicated, be made of various materials of construction, such as metal, wood or plastic. The menu board itself may be formed in various ways, e.g., by routing from a larger sheet of material or by molding. The menu board windows 11, 12, 14 and 34, 35, 36 may be routed or otherwise formed as by casting. The menu board with its windows may be formed in unitary fashion, or it may be assembled using individual pieces of material.

In the embodiment of FIG. 7, however, each of the windows 34, 35, 36 extends across the full length of the menu board 32, i.e., without any intervening vertical members or struts as shown interrupting the center of the lower two openings of the menu board of FIG. 1 to thereby separate each full length opening into several shorter portions.

As will be seen from FIG. 11, the character strips employed to depict prices are generally the same as shown in FIGS. 1–6. Thus, removable character members 15, 16, 18 depicting price information are shown in FIG. 11 in the same relationship to one another as in FIGS. 1–6. In FIG. 11, however, the alignment tabs **15*b*, 16*b*, 18*b* (and ear portions or appendages 15*c*, 16*c*, 18*c***) are shown darkened or opaque. In the case of a back-lighted menu board, this may be desirable in some instances to prevent light leakage around the margins of the character members, which might render the board information less distinct as viewed from the front.

In the embodiment of FIGS. 7–11, a character strip 37 is provided bearing letters describing the product, for example the name of a sandwich, or "salad" or the like. Like the character strips 15, 16, 18, the strip 37 is formed of thin transparent plastic or like material and carries letters outlined and thereby defined by a surrounding opaque or dark area **37*a*. The strip 37 includes an alignment and anchoring tab 37*b* including a lower ear portion or appendage 37*c*, having functions like the tabs 15*b*, 16*b*, 18*b* and appendages 15*c*, 16*c*, 18*c*** of the strips carrying the price information.

The full length window arrangement of FIG. 7 provides added flexibility to the use of the board. For example, no longer is there any problem in fitting various menu items, such as sandwich names, and prices into a series of axially aligned openings of varying lengths which may not be changed without changing to a completely new menu board. Thus, in the menu board of FIG. 7, the board windows 34, 35, 36 are completely open from one end of the board to the other so as to accomodate any combination of product names, prices, or the like. For example, a given menu board format might show "Hamburgers" for "$0.89", as depicted in window 34 of FIG. 7. The store proprietor might then wish to change this item to "Hamburgers with Fries" for "$1.28", as shown in window 35 of FIG. 7. In this event, the change could be carried out within the window 34 by substituting a new character strip 37 containing the letters "Hamburgers with Fries" for the original strip reading "Hamburgers". This substitution is accomplished by sliding the old character strip out from behind the board window, and sliding the new one in, without the interference of any intervening vertical member (such as shown in the lower center portion of FIG. 1).

As previously described in connection with FIGS. 1–6, the spaced, elongated bars 19 on the back of the menu board arranged along the lateral edges of the board windows 11, 12, 14 may be of H-shaped cross section. In this event, the bars define elongated sleeves or pockets 28 (see FIG. 2) for receiving the digits or character members 15, 16, 18, 37.

FIGS. 8 and 9 depict the bar 19 as well as variations, i.e., several alternative constructions of spaced bars are shown. Thus, the cross section of the bar may be T-shaped as shown in bar 38, or a double T-shape as depicted in bar 39, or a double H-shape as shown in bar 40.

Use of the H-shaped bar construction (19) will, of course, result in formation of a sleeve or pocket 28 (as shown in FIG. 2) as previously described, with the end **19*a* of the bar functioning as a stop. Similarly use of the T-shaped bar 38 results in a sleeve 41 of similar size and shape. In the double T (39) and double H (40) shaped embodiments of the bar, a pair of parallel sleeves are defined by the bars. That is, an inner sleeve or pocket is defined immediately adjacent to the back surface of the menu board, and a second, parallel outer sleeve is defined just behind the first sleeve. Thus, as shown in FIGS. 8 and 9, the double T bar 39 defines inner 42 and outer 44 sleeves, and the double H bar defines inner 45 and outer sleeves 46. In the case of each of the bars 38, 39, 40, their ends may function as stops in the same manner as the stop 19*a* on bar 19. In these arrangements, it may be desirable for the background member 29 and character strips 15, 16, 18 to be inserted into the inner sleeve (42 or 45) only, in the same manner as previously described in connection with FIGS. 1–6. Alternatively, it may be preferred to select the width of the two parallel sleeves such that the inner sleeves (42 or 45) carry the thin character strips 15, 16, 18, and the outer sleeves (44 or 46) carry the background member 29. In this event, the numerals or letters in the front sleeve may be held in place by a friction fit, i.e., by making the width of the sleeve commensurate with the thickness of the plastic used for the numerals or letters. In these alternatives, it may or may not be necessary to use locking clips 30 to hold the background member 29** in place.

The double T (39) and double H-shape (40) bars have the advantage that they provide additional strength for the board itself in some situations, such as where the source of back lighting for the menu board is in a confined space in which intense heat is created.

In keeping with one of the features of the invention, means is provided in the construction of the bars 19, 38, 39, 40, to anchor and thereby secure the character strips 15, 16, 18, 37 in any location desired along the length of the menu board windows 34, 35, 36. This is accomplished by providing a plurality of axially spaced vertical slots 48 located in the bars at selected intervals, for example one to four inches apart along their length. These slots 48 are sized and spaced in such manner that they snugly receive the appendages **15*c*, 16*c*, 18*c*, 37*c* of the alignment tabs carried by the character strips (for example, see exploded depiction in upper portion of FIG. 9). This arrangement permits the numerals, letters or word character strips to be anchored to the board windows at any location along their length where an ear portion of one of their respective alignment tabs may interlock with a slot 48**.

In practice, then, the embodiment of the invention depicted in FIGS. 7–11 is used generally the same as the embodiment of FIGS. 1–6. As seen from FIG. 11, a series of digit or character carrying members 15, 16, 18, 37 may be placed as desired in the sleeves or pockets (e.g., 28, 41, 42, 45) defined by the bars 19, 38, 39, 40. Preferably, where the character strips are of clear, transparent plastic, the digits or other characters may be outlined and thereby defined by a surrounding opaque or dark surface as shown in the left hand portion of FIG. 11. A series of digits, in this case forming the price "$3.11", are placed in the sleeve behind the window opening in such manner in relation to the menu description (37) that a slight overlap of opaque surfaces is provided. This is shown by the arrows in FIG. 11. In this way, assurance is given that there will be no light leakage from behind the menu board which would interfere with the beauty or legibility of the menu items as viewed from the front of the board.

Use of the slot 48 arrangement provides still additional flexibility to my menu board. For example, two or more different products and corresponding prices may be displayed in end-to-end fashion along a single board window. This may be seen from FIG. 7, which shows (see cut-a-way) a plurality of vertical slots 48 arranged along a given bar (e.g., 19) associated with a single board window 36. As shown, the first slot from the right hand side of the window (as viewed from the front of the menu board) is designated 48*a*. The next slot, spaced a few inches away, is designated 48*b*. Illustrative successive slots arranged along the window 36 are designated 48*c*, 48*d*, and 48*e*.

Thus, a first menu item of "Hamburger & Salad" for "$3.11" might appear at the right hand side of the window. The character strips 37, 15, 16 and 18 may be mounted on the board to accomplish this as shown in FIG. 11, with the appendages 37*c*, 15*c*, 16*c*, 18*c* of the character strips engaged against the end portion 19*a* of the H-bar as described above and shown in FIG. 3. In this illustration, the slots 48*a* and 48*b*, for example, might not be utilized since the end 19*a* of the H-bar is used to anchor this menu item and the length of the item is such as to cover the slots 48*a* and 48*b*.

Then, a second menu item, for example "Fries" for "$0.45", may be displayed in the same window 36, but spaced to the left (again, as viewed from the front of the menu board) of the first menu item. This may be accomplished by sliding a group of character strips, including a strip 37 carrying the word "Fries", a strip 16 carrying the numeral and decimal point "0.4", and a strip 18 carrying the numeral "5", along the appropriate sleeve (for example, 28) behind the window until the group of strips is in place with their aligned locking appendages 37*c*, 16*c*, 18*c* located adjacent the slot 48*c*. Then, the second menu item is mounted within the left portion of the window 36 by manually snapping the ears 37*c*, 16*c*, 18*c* into locking engagement with the slot 48*c* as described above.

In similar fashion, other menu items may be placed along the same board window 36, to the left of the first two menu items, by utilizing the mounting slots 48*d* and 48*e*.

Still another alternative display arrangement may be employed utilizing my invention. Instead of overlapping the various character strips (as seen from the back of the menu board) in a single group to form a given menu item and price, as described above, separate character strips may be individually mounted in end-to-end fashion to form a single menu item. Thus, the first menu item described above, "Hamburger & Salad" for "$3.11", may alternatively be displayed utilizing four separate character strips, each being only of sufficient length to display its letters or digit. That is, since the character strips are to be mounted end-to-end (rather than with some overlying others), there is no need to provide any clear, transparent areas in these strips (see FIG. 4) to provide show-through visibility of the indicia presented on the strips which underlie others.

In this alternative, each digit strip 15 (i.e., the "$3"),16 (i.e., the "0.1"), and 18 (the "1") may all be of the size and shape of strip 18 (the shortest one). Similarly, the letter strip 37 (i.e., the "Hamburger & Salad") need not be provided with the clear transparent area shown in FIG. 11. In such an arrangement, the strip 37 may be mounted (via locking appendage 37*c*), for example, in slot 48*d*, with the digit strip 15 (and appendage 15*c*) mounted in slot 48*c*, the digit strip 16 (and appendage 16*c*) mounted in slot 48*b*, and the digit strip 18 (and appendage 18*c*) mounted in slot 48*a*. Of course, in such an arrangement, the slots 48*a*, *b*, *c*, and *d* would be spaced closer together than in the embodiments described previously, for example only about an inch apart. Also, it may be preferable in such an arrangement for each strip 37, 15, 16, 18 to slightly overlap the next adjacent strip along their marginal edges in order to prevent light leakage as described above.

Many alternatives fall within the scope of my invention. For example, the digits or numerals on the character strips 15, 16, 18, 37 may be dark or opaque, surrounded by clear transparent areas, rather than vice versa. This alternative may be preferable where the overall opaque or black background is not desired for appearance purposes.

There are also alternative arrangements that may be used to fix the character strips in the board windows. In one alternative, the copy (i.e., numerals, sandwich names) is silk-screened or otherwise placed directly onto the thin strips of clear acetate or other similar clear plastic material 15, 16, 18, 37. In this arrangement, the colored plastic background member 29 is then placed behind the clear acetate character strips to provide contrast (as viewed from the front of the menu board), and the colored member may be locked in place using the locking clips 30 as before.

In another alternative, a single colored plastic member, like the background member 29 but having letters or numerals silk-screened onto it, and including an alignment tab and ear (like 37*b* and *c*), is used for the sandwich names only. This single member then fits into the sleeve behind the board window and locks into place via the ear and an adjacent slot 48. The arrangement for the prices may be the same as described above.

Another feature of the invention concerns alternative locations of the decimal point in a price arrangement. In FIGS. 1–6, the decimal point appears along with the digit in the third position from the end of the board, i.e., the digit from 1 to 9 which indicates the dollars. This is because with some products such as sandwiches, every item on the board may be under $10.00. However, where the price of the product item on the board exceeds $10.00, it is desirable for the decimal point to be moved from the digit in the third position to the digit in the second position in order to provide flexibility as to the dollar amount. In other words, by placing the decimal point on the second digit, which is the tenths (see FIG. 11), the character strip in the third position (15)

may be used to designate dollar amounts from $10.00 on up to $100.00 or higher.

One of the advantages of my invention is that it has special applicability to fast-food type restaurants having an outdoor drive-through window. In such situations, the restaurant necessarily must provide outdoor menu boards or signs. In such outdoor signs, moisture and condensation may collect between the overlapping letters or numbers on the sign, and when freezing takes place, the resulting ice formed between such letters and numbers often renders them illegible. Through use of my invention, moisture or ice cannot be trapped between the various numbers or letters; they always remain visible.

My invention provides a simple yet exacting way of perfectly aligning the characters in a menu board in such manner that they are clearly legible, easily inserted and easily removed (for example, to change prices).

I claim as my invention:

1. A menu board comprising, in combination, a generally flat board member provided with a window-like opening, sleeve means associated with said board arranged along the lateral edges of said opening defining a flat sleeve generally coextensive with and behind said opening, a plurality of flat, planar character members disposed in said board sleeve and visible from the front of the menu board through the opening, means for securing the character members to the menu board at selected positions within the opening, said securing means including at one end of each character member an appendage engageable with a portion of said sleeve means to thereby locate and lock the character members in the position selected within the opening, each of said character members being transparent except for an opaque character display area at the end thereof opposite said appendage, a first one of said character members being coextensive in length with the board opening and having its opaque area located at one end of said opening, a second one of said character members being shorter in length than said first character member and overlying said first member with its opaque area abutting the opaque area of said first member, and a third one of said character members being shorter in length than said second character member and overlying said second member with its opaque area abutting the opaque area of said second member, the character members of different lengths being arranged with respect to each other so that when overlaid one upon the other with their appendages aligned at the same end each character member does not overlie any opaque character display area carried by another character member as viewed from the front of the menu board to thereby equally present the character members without glare or reflection whereby the necessity for a glare reducing face panel for the menu board is obviated, the character members thus being arranged with respect to each other so that all of the opaque character display areas carried thereon are simultaneously visible from the front of the menu board without diminishment of clarity or intensity of the display areas due to overlapping layers of the character members, with said character display areas cooperating with one another to depict a single item of menu board information.

2. The menu board defined in claim 1 in which the sleeve means includes an elongated bar providing stop means at one end which stop means is the portion of the sleeve means engageable by the appendage to thereby locate and lock the character member in the selected position.

3. The menu board defined in claim 2 in which the securing means includes a thin, concave sheet with its longitudinal marginal edges interposed between the longitudinal marginal edges of the character members and the elongated bar.

4. The menu board defined in claim 1 in which the sleeve means includes an elongated bar having an H-shaped cross section.

5. The menu board defined in claim 1 in which the flat planar character members are thin strips of plastic, partially opaque and partially transparent.

6. The menu board defined in claim 1 in which the flat planar character members are thin strips of opaque plastic sheet carrying characters having a color contrasting to that of the plastic sheet itself.

* * * * *